United States Patent [19]

Seno

[11] Patent Number: 5,006,053

[45] Date of Patent: Apr. 9, 1991

[54] VERTICAL SINGLE BLADE ROTARY PUMP

[76] Inventor: Cornelio L. Seno, c/o Ibrahim Abunayyan Organization, P.O. Box 71, Riyadh, 11411, Saudi Arabia

[21] Appl. No.: 25,187

[22] Filed: Mar. 12, 1987

[51] Int. Cl.[5] ..... F04C 2/344

[52] U.S. Cl. ..... 418/150; 418/255

[58] Field of Search ..... 418/253-255, 418/150

[56] References Cited

U.S. PATENT DOCUMENTS

| | | | |
|---|---|---|---|
| 118,366 | 8/1871 | Hege | 418/255 |
| 802,843 | 10/1905 | Corelison | 418/255 |
| 861,937 | 7/1907 | Beach | 418/255 |
| 899,040 | 9/1908 | Gill | 418/255 |
| 914,022 | 3/1909 | Darlington | 418/255 |
| 1,442,198 | 1/1923 | Utley | 418/255 |
| 1,715,629 | 6/1929 | Shore | 418/255 |
| 1,952,834 | 3/1934 | Beidler et al. | 418/255 |
| 2,278,740 | 4/1942 | Roessler | 418/150 |
| 2,903,971 | 9/1959 | Collins | 418/255 |
| 4,097,205 | 6/1978 | Miles | 418/255 |

FOREIGN PATENT DOCUMENTS

| | | | |
|---|---|---|---|
| 2521190 | 11/1975 | Fed. Rep. of Germany | 418/150 |
| 2366467 | 4/1978 | France | 418/255 |
| 49-3530 | 1/1974 | Japan | 418/150 |

*Primary Examiner*—John J. Vrablik

[57] ABSTRACT

The invention relates to rotary vane type Positive Displacement Pumps having rotating slotted shaft in which is inserted single blade whose both ends touch the stationary shell assembly at all times because the blade's length substantially fits between the two intercepted interior surfaces of the shell assembly, thus maintaining separate suction (low pressure) and discharge (high pressure) regions always. The rotation of the shaft and the limited boundary imposed by the shell assembly actuate the blade to oscillate in the slot of the shaft while sweeping round the pumping chamber effecting continuous enlargement of the suction region and contraction of discharge region, with the end result of pumping liquid at constant flow per shaft rotation irrespective of head and pump power output.

1 Claim, 7 Drawing Sheets

VERTICAL SINGLE BLADE ROTARY PUMP

OBJECTIVE

The object of this invention is a pump that is cheap, simple, efficient, sturdy, easy to manufacture, maintain and repair, as well as that delivering constant flow at specific shaft rotative speed and number of shell modules.

BENEFITS

The application of the invention has several advantages. The invention is self priming pump because it is of the positive displacement type. It follows that it discharges virtually fixed volume of water at constant speed and number of shell modules for all levels of pressure and pump power output, as long as the pump materials can withstand the hydraulic pressure, the shaft can safely transmit the power requirement, and the prime mover is capable of running the pump. The number of shell modules can be varied to obtain different pump flow ratings using same sizes of parts, with the exception of slotted shaft and blade that vary in length. Compared to other rotary pumps, the invention discharges biggest flow per revolution because of largest possible size of blade and space inside pumping chamber. This claim is justified by noting that the maximum blade protrution in other rotary pumps rarely exceeds ¼ of the diameter of slotted shaft; whereas in the invention, it is twice the diameter of the slotted shaft as specified below, and it can even exceed this benchmark. The invention is easy and inexpensive to manufacture, maintain and repair because it consists of few and simple parts. The method of manufacturing does not entail casting and forging but simply utilizes the lathe, milling machine, drill, welding equipment and other small tools. Its price is comparatively cheap because only one stage is required when other pump types need to be multi-stage for most applications requiring high total dynamic head. The vertical pump version of the invention imposes no hydraulic thrust on the rotating assembly, which in some instances will dictate smaller sizes of line shaft and right angle gear drive than those for equivalent deepwell turbine pump. The effective hydraulic thrust is carried by the column pipes which stretch negligibly because of their big cross sectional area. Therefore, the line shaft is designed to transmit pump power requirement only without due regard to shaft stretch and end play limitation. When the blade edges and the shell interior wear out, the pumping effectiveness is negligibly affected as long as the pump is running at desirable speed, because centrifugal force keeps the blade to touch the shell from just past the suction port to just before the discharge port.

One shortcoming of the vertical single blade rotary pump is the assymetry of the bowl assembly in the horizontal plane. However, its effect on vibrations of the pump is softer than that occurring in deepwell turbine pump because there is only one stage in the invention whose mass is negligible enough to create serious vibrations, as long as the pump is not running at or near its natural frequency. In contrast, the tangential component of the centrifugal force exerted by swirling water upon the bowl of deepwell turbine pump when multiplied by the number of stages, too often comes out to be considerable to create vibrations because of the magnitude of mass causing the imbalance.

SPECIFICATION AND DRAWINGS

The benefits from and advantages of the invention are apparent in the following specification and drawings in which.

The independent parts of the invention which can be physically separated as whole objects are designated by Arabic numerals, whereas, the subparts of the independent parts are represented by Roman letters. Similar numerals and letters of reference relate to like parts in all figures of the drawings.

ASSEMBLY OF THE INVENTION

Figure 5:
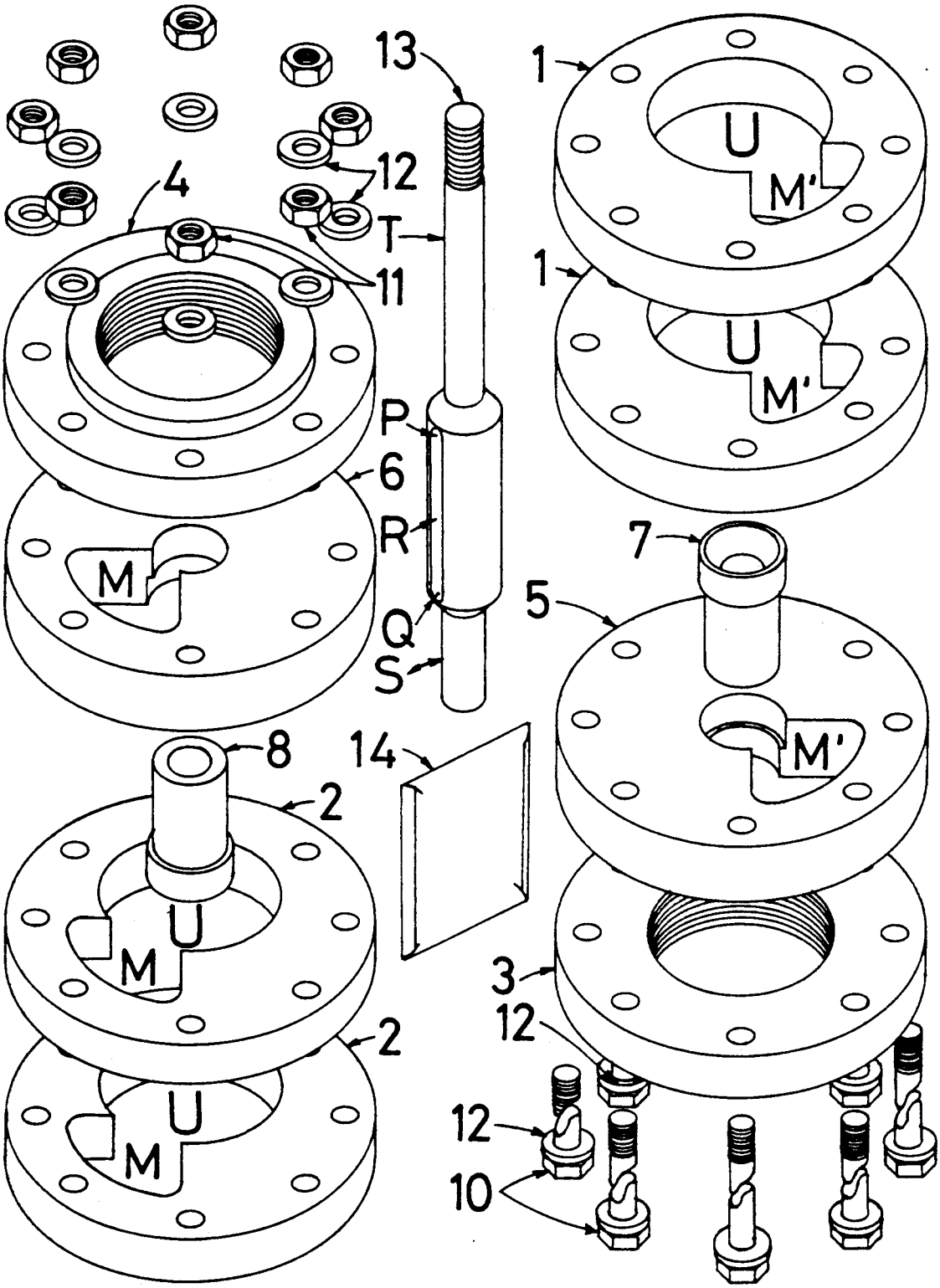
FIG. 5 is the expladed view of the single blade rotary pump.

FIG. 5 divides the invention into three groups of parts, namely, the top stationary parts shown in the left, the rotor assembly in the middle, and the bottom stationary parts in the right side. The rotor assembly consists of single shaft 13 and single blade 14 inserted in the continuous radial slot of the former. The stationary parts are assembled in the same order as they are arranged in FIG. 5. The rotor assembly is enclosed and supported by the stationary parts which are held together by bolts 10, washers 12 and nuts 11. Bottom sleeve bearing 7 is force fitted into the hole of suction end plate 5, while top sleeve bearing 8 is force fitted into the hole of discharge end plate 6. The bottom stationary parts, namely, suction flange 3, suction end plate 5 with sleeve bearing 7, and bottom set of shell modules 1 are slid onto bolts 10 with washers 12. In between them are gaskets 9 for sealing. When assembled, the ports M' of the suction end plate 5 and the bottom set of shell modules 1 have identical orientation and form the integral suction port M'. The shaft 13 with blade 14 in its slot R are mounted inside the sweeping cavity U of the bottom stationary parts, the short shaft extension S with taper being journalled in the bottom sleeve bearing 7. The top stationary parts, namely, top set of shell modules 2, discharge end plate 6 with sleeve bearing 8, and discharge flange 4 are slid onto bolts 10, while the long shaft extension T with taper is journalled in the top sleeve bearing 8. Again, there are gaskets 9 in between the mating parts for sealing. When assembled, the ports M of the top set of shell modules 2 and the discharge end plate 6 have identical orientation and form the integral suction port M. If the orthographic top view of the pump is divided into four quadrants whose common center is also the center of the shaft 13, in general, the integral suction port M' is in the first quadrant while the integral discharge port M is adjacent to it in the second quadrant reckoned in the direction opposite to the rotational direction of the shaft 13 and blade 14. The blade 14 serves as the jig during the assembly of the invention to give smooth surface of the sweeping cavity U of the shell assembly 1 and 2, the greater portion of which occupies the third and fourth quadrants. The pump assembly is secured by tightening the bolts 10 with washers 12 and nuts 11. The suction pipe with strainer is screwed into the suction flange 3, the column pipe is screwed into the discharge flange 4, the line shaft is connected to the pump shaft 13 with shaft coupling, spiders centralize and stabilize the line shaft inside the column, the column is screwed into the discharge head while the top shaft is secured to the driver's clutch.

CONSTRUCTION

The invention meets two important conditions favoring sealing. First is that at any angular orientation of the shaft 13 and blade 14 inside the sweeping cavity U of the shell modules 1 and 2, both vertical edges of the blade 14 which is inserted in the slot R of the shaft 13, always touch the surface of the sweeping cavity U. Said in another way, the surface of the sweeping cavity U of the shell modules 1 and 2 is the only path of the tips of the blade 14. Second is that the integral suction port M' and the integral discharge port M are always separated by the blade 14 and pump shaft 13 inside the sweeping cavity U of the shell modules 1 and 2. At no instance is there spatial connection between these two ports save for the working clearances between parts. There is therefore clear division between the low pressure suction region behind the blade 14 and open to suction port M', and the high pressure discharge region in front of the blade 14 and open to discharge port M.

Figure 6:
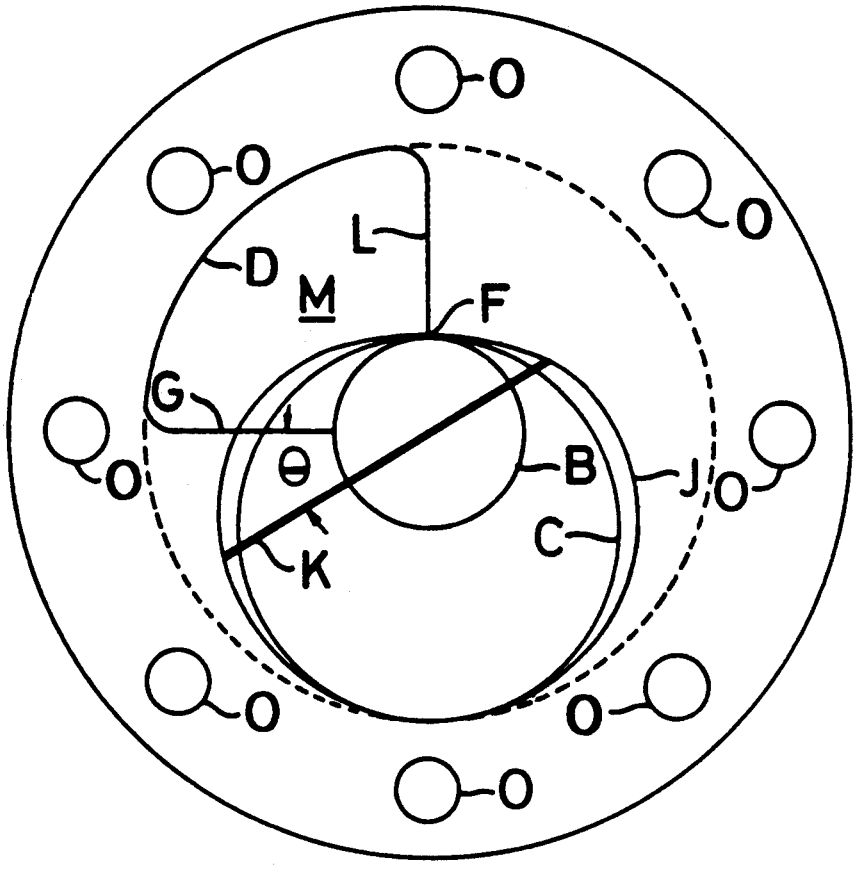
FIG. 6 is the geometric diagram serving as basis of the construction of shell modules, suction and discharge end plates and suction and discharge flanges.

FIG. 6 is the basis of the construction of shell modules 1 and 2, end plates 5 and 6, and flanges 3 and 4. These parts are made from mild steal plate by marking paterns using templates, oxy-acetylene torch cutting, drilling, lathing and milling. About center point A are struck circles B, D and E. Circle B represents the slotted shaft 13 having diameter B. Circle D serves as boundary from center A where removal of metal is allowed (excluding bolt holes), and having diameter 3B. Circle E defines the periphery of the shell modules 1 and 2, end plates 5 and 6, and flanges 3 and 4. The vertical line F and horizontal line G intersect with each other at point A. Horizontal line H is parallel to line G, is B/2 distance from A, and intersects line F at point I. About point I, circle C is struck having diameter 2B. Curve J is the silhouette of the sweeping cavity U of the shell modules 1 and 2, which is the locus of points generated by both tips of line K representing the blade 14 having invariable length 2B, as it rotates while passing through point A and maintaining equal distances of its tips from its intersections with circle C. Taking point A as the origin and adopting the polar coordinate system, circle B is defined by the function $r=B/2$, while circle c is defined by the function $r=0.5\ B\ (\sin\theta+\sqrt{\sin^2\theta+3})$ where r is the distance of the curve from the origin A at an angle $\theta$ reckoned counterclockwise from the left side of the horizontal line G. The limiting condition of equal distances of tips of line K from its intersections with circle C is satisfied by the following equation:

$$r=B(1+0.5\sin\theta)$$

Figure 7:
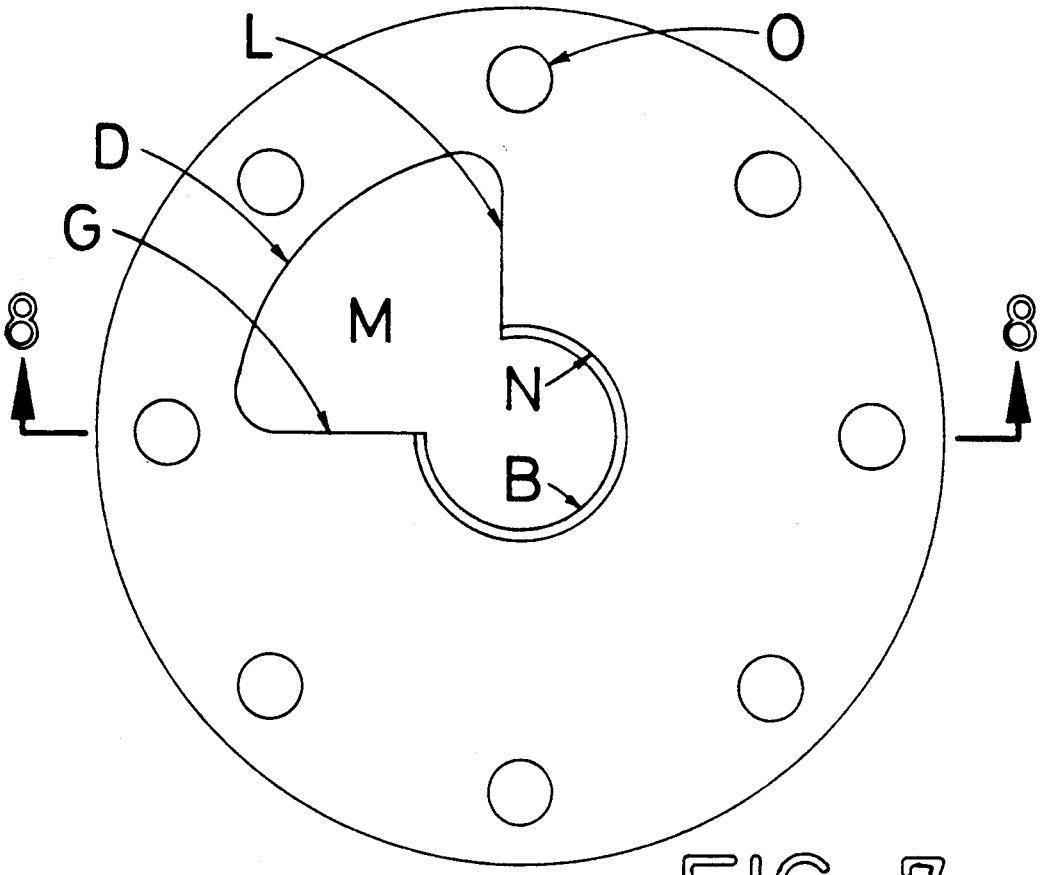
FIG. 7 is the plan of the suction end plate.
Figure 8:
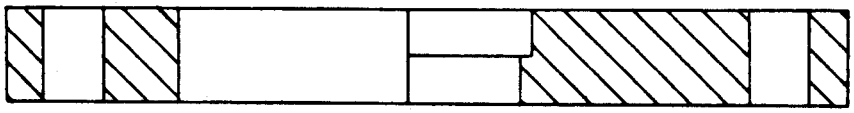
FIG. 8 is the radial section of the suction end plate along line 8—8 of FIG. 7.
Figure 9:
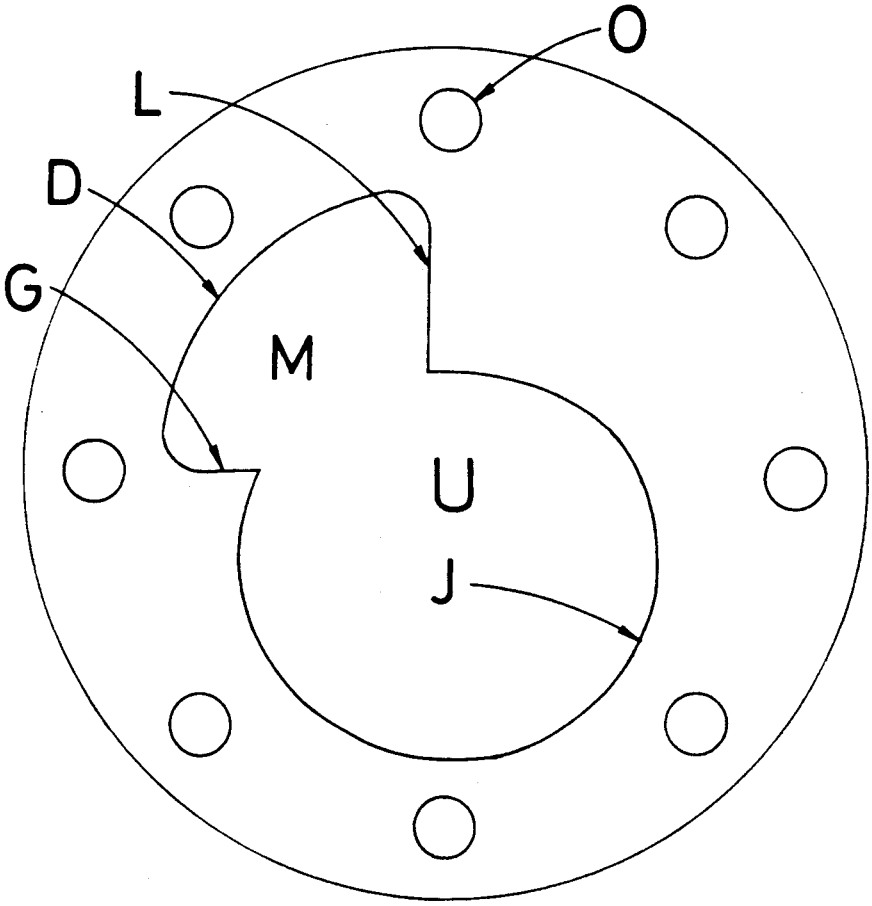
FIG. 9 is the plan of the shell module.

Vertical line L is parallel to line F and is half the blade thickness from line F. Due to milling limitation, the corners of opening where line G and circle D, and line L and circle D intersect are round and not sharp. The port M which is the area bounded by the circle D, line G and Line M are milled out from plates for both shell modules 1 and 2 and end plates 5 and 6. The area bounded by curve J is also milled out in the shell modules 1 and 2; however, in the end plates 5 and 6, the circle B is bored on lathe instead, afterwhich it is countersunk. The location of port M in relation to the countersunk recess N (see FIG. 7) depends on the rotational direction of the driver. If the countersunk recess N is on top of the plate and the port M is above the former, then clockwise rotation locates the port M to the right, and anti-clockwise rotation places the port M to the left. Between circles D and E are circles O that are drilled for bolting. This task applies to shell modules 1 and 2, end plates 5 and 6, and flanges 3 and 4.

The blade 14 is made from flat mild steel plate by oxy-acetylene torch cutting and machining on shaper, having finished horizontal width 2B and vertical length NT, where N and T are number and thickness of shell modules 1 and 2, respectively. The horizontal edges of the blade 14 are round like the slot edges of the shaft 13, while its vertical edges are wedge shaped permitting constant contact between the vertical edges of the blade 14 and the surface of the sweeping cavity U of the shell modules 1 and 2.

The shaft 13 is made from cold rolled carbon steel round bar by sawing, drilling two holes P and Q, milling the space R between them, and turning on lathe to give the short extension s and long extension T with threaded end. The shaft 13 has two diameters: B at middle part with slot and 0.5 B at short and long extensions S and T, the two transitions being tapered to soften stress concentration.

The sleeve bearings 7 and 8 are made from bronze hollow bar by turning on lathe. The external diameters of the sleeve bearings 7 and 8 are slightly bigger than the diameter of the continuous bore B and the countersunk recess N of the end plates 5 and 6 to give an interference of 0.00025 B. The inner hole diameter with tapered countersunk recess is slightly bigger than the diameter of the long and short extensions T and S of the shaft 13 providing an allowance of 0.0014 B[§].

The gaskets 9 that assume the forms of contact areas of mating parts can either be cut sheets of rubber or vegetable fiber, or moldable polymer gasketing material applied and cured. The bolts 10, nuts 11 and washers 12 are procured from hardware store.

OPERATING PRINCIPLE

Figure 1:
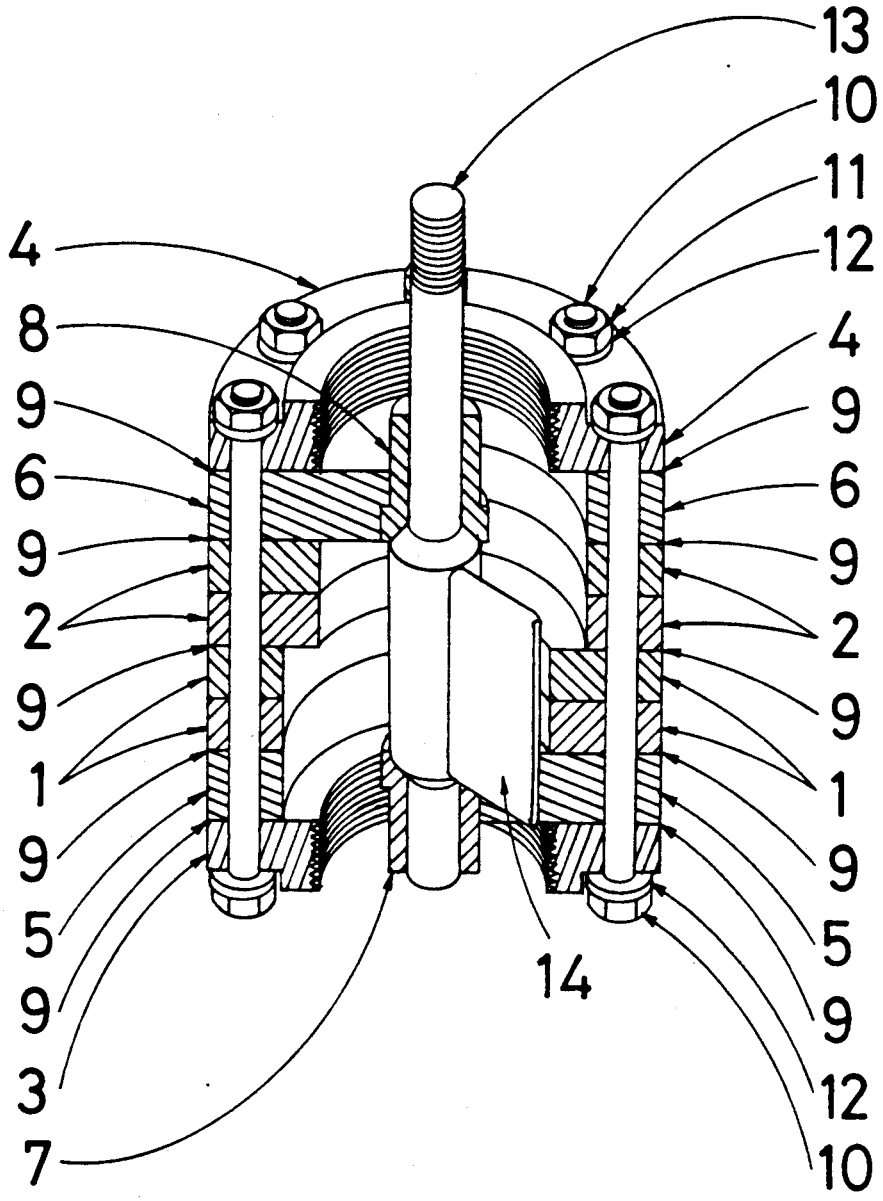
FIG. 1 is the three dimensional cut away view showing the internal features of the single blade rotary pump.
Figure 2:
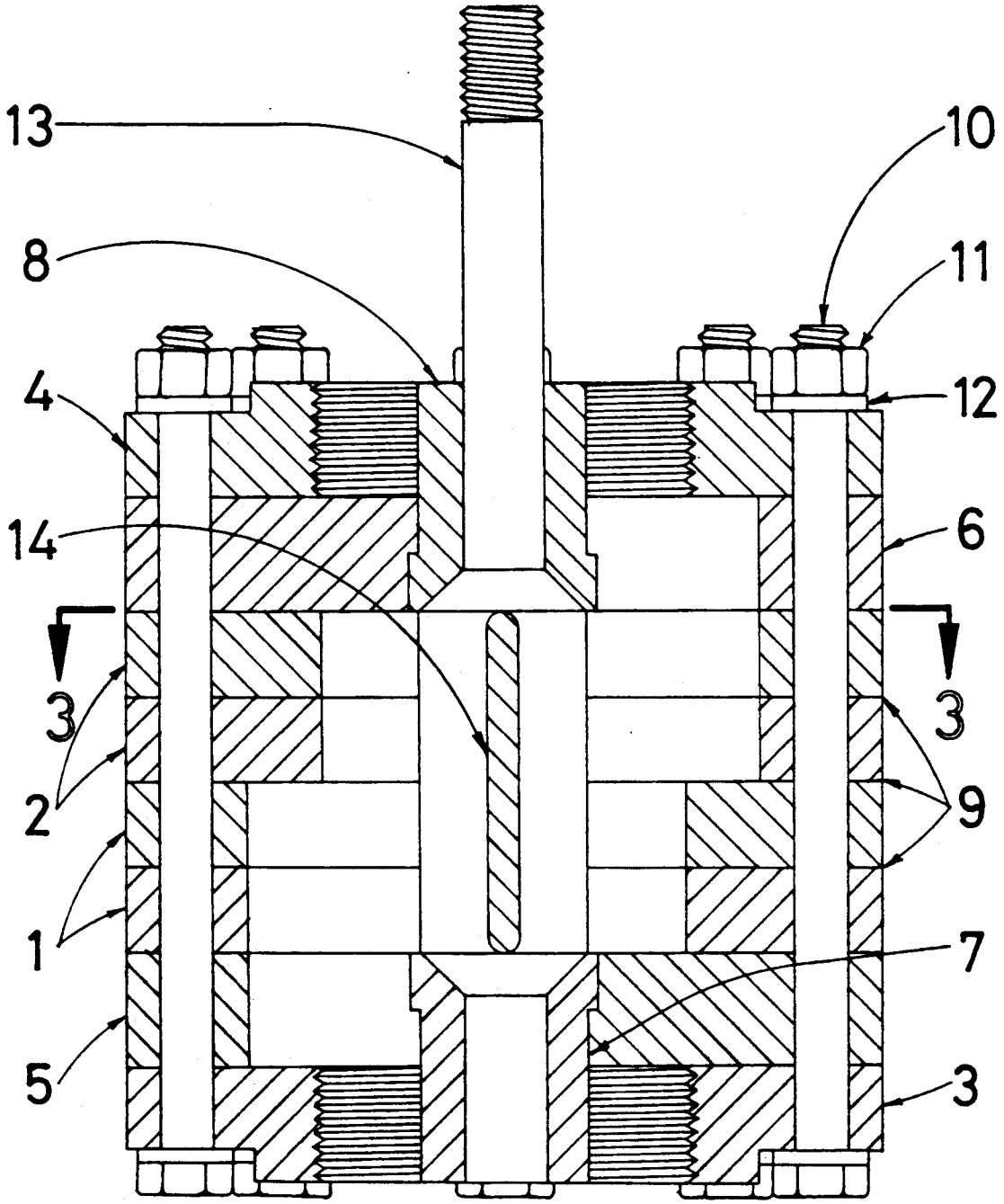
FIG. 2 is the radial section of the single blade rotary pump.
Figure 3:
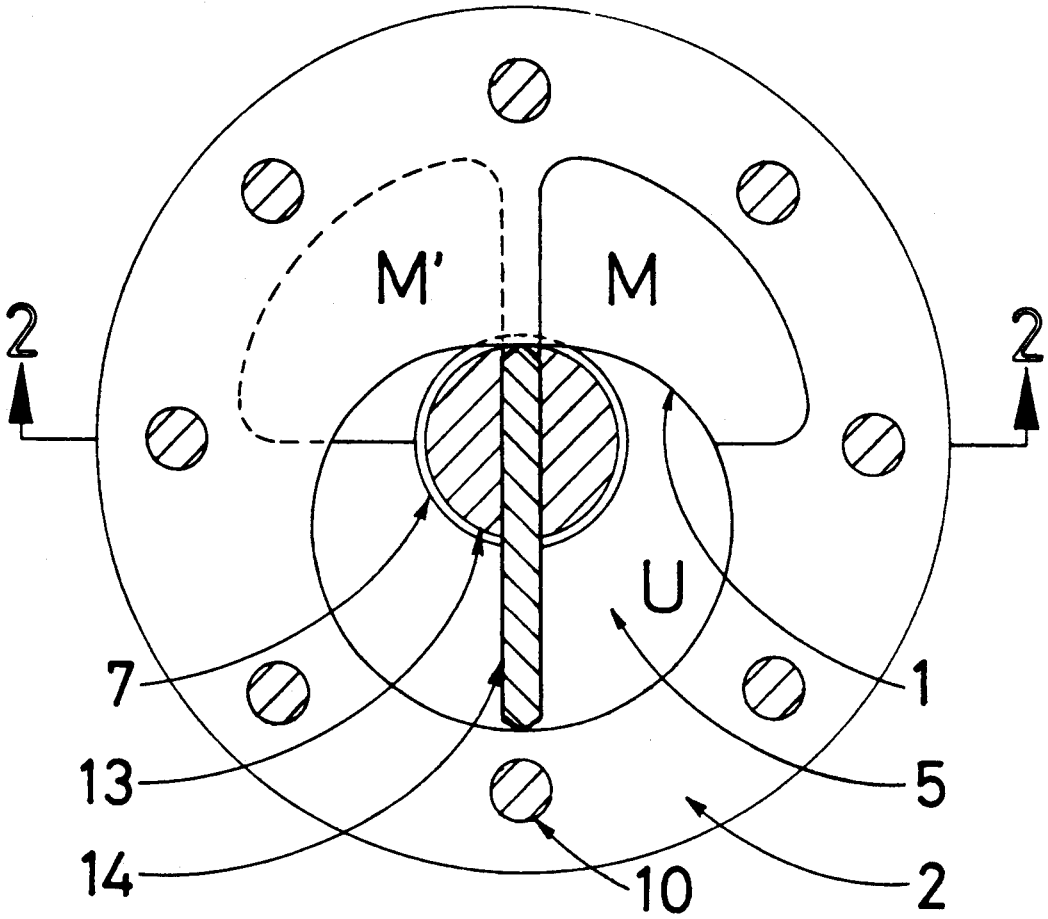
FIG. 3 is the transverse section of the single blade rotary pump along line 3—3 of FIG. 2.
Figure 4:
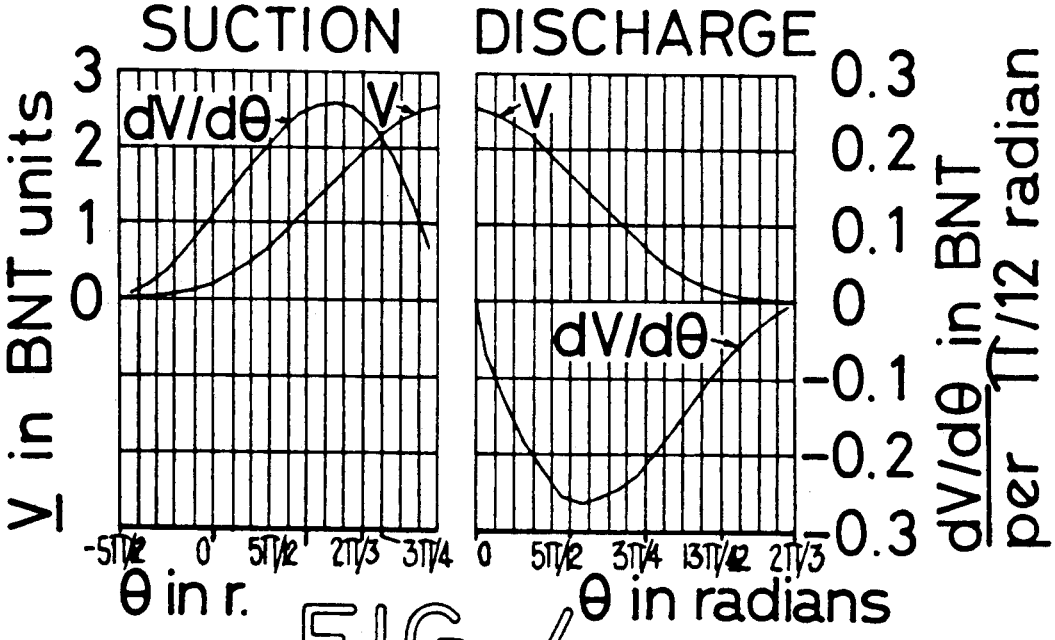
FIG. 4 is the isometric drawing of the single blade rotary pump showing its external features.

Scrutiny of FIGS. 1, 2 and 3 reveals that the pumping action of the invention is due to changes in volumes of the suction and discharge regions inside the pump as the blade 14 sweeps round the sweeping cavity U of the shell assembly comprising shell modules 1 and 2, and oscillates in the slot of the rotating shaft 13. The shell modules 1 and 2 constrain both ends of the blade 14 because the length of the latter exactly fits between the two intercepted lines on interior surface of the shell assembly at any angular orientation of the blade 14. Whereas, the shaft 13 holds the blade 14 at sides and edges but allows it to rectilinearly oscillate in the slot. Consequently, the space inside the pump is divided at all times into separate suction (low pressure) and discharge (high pressure) regions. With reference to the blade 14, the suction region is behind it while the discharge region is in front. The pumping operation comprises suction and discharge stages happening concommitantly as the slotted shaft 13 rotates. The operation is analyzed by following the path of the end of the blade 14 from the suction port to the discharge port. The suction stage commences when the blade 14 assumes the position in FIG. 3. As the slotted shaft 13 rotates counterclockwise, with reference to FIG. 3, the blade 14 leaves void behind in the suction region. Being virtually vacuum, the void is instantaneously occupied by the liquid from the suction port by virtue of the hydraulic pressure gradient between the void with negative pressure and its liquid neighborhood having positive pressure. As the blade 14 advances, the suction region volume continues to enlarge. There is no time when the suction region volume decreases. The suction stage ends when the blade 14 assumes the relative position of line H of FIG. 6 which is perpendicular to its position at the start and the blade end being followed has reached the discharge port. At this instance, the next suction stage is already in progress, there being an overlap of 90 degrees.

While suction stage occurs behind the blade 14 discharge stage simulataneously progresses in front of the blade 14. Discharge stage commences when the blade ends protrude equally from shaft slot, entrapped volume of liquid is maximum at 2.565 $B^2NT$, the suction port has just been close to this maximum volume and the discharge port is impending to open with slight counterclockwise turning of the shaft 13. From maximum volume to minimum volume, the involved space being followed is called discharge region which is under high pressure. The analysis begins once more at the suction port going towards the discharge port. As the shaft 13 rotates counterclockwise and the blade 14 sweeps round the shell modules 1 and 2, respectively the volume of the discharge region diminishes without interruption. There is no instance when the discharge region stops to decrease or enlarges. Consequently, the entrapped liquid exits through the discharge port. The discharge stage is consummated and the next discharge stage is in progress by 90 degrees.

Since the blade 14 has two ends that protrude from the slotted shaft 13, suction and discharge stages occur twice simultaneously every turn of the shaft 13. Therefore, the theoretical flow per revolution q is twice the maximum volume of either suction or discharge region, less the slip, the quantity of liquid that leaks through clearances. With a shell assembly width of NT, maximum entrapped volume of 2.565 $B^2NT$ the theoretical flow per revolution q is 5.130 $B^2NT$ per revolution.

The above expression implies that flow can be increased by increasing the number of shell modules and subsequently lengthening the slotted shaft and blade; by increasing the rotative speed; and increasing the diameter of the slotted shaft and subsequently increasing the size of the pumping chamber. The flow can be lowered by doing the reverse.

For the invention is positive displacement pump, flow is constant at specific speed and number of shell modules, however, the power imparted by the pump to the liquid it discharges is a function of flow and head. This pump power output P in water-kilowatts is $$P = \frac{60qHS}{366EFF} = \frac{0.84B^2NTHS}{\text{Efficiency}}$$

where S is rotative speed in rpm, H is total head in meters. Since the invention is a positive displacement pump, flow is constant at fixed rotative speed and number of shell modules, and a specific single blade rotary pump is capable of delivering virtually fixed flow at constant RPM at any head to the limit of structural strength of the materials of the pump. The critical task is sizing the prime mover that must provide the brakepower enough for pump power output, power losses due to friction, elevated temperature and altitude, and inefficiencies.

The proportional dimensions of the slotted shaft and blade are arbitrarily adopted in the foregoing analysis in order to give physical embodiment to the invention to facilitate understanding, as well as to show that the invention can have practical dimensions. However, this proportion can be varied to widen the range of the invention's duties and applications.

Having thus described my invention, what I claim as new is:

1. A vertical single blade rotary pump comprising:

A. single round shaft having continuous radial slot that holds and allows rectilinear oscillation of the blade, said shaft tapers off after the slot towards both ends to reduce diameter, the longer end protruding out of the casing assembly to receive the brakepower needed to run the pump;

B. single rectangular flat plate blade with round horizontal edges and wedge shaped vertical edges;

C. a shell assembly comprising multiple number of shell modules that can be varied in quantity to achieve the required flow, having interior surface following the curve of the function $r=B(1+0.5 \sin \theta)$, where B is slotted shaft's diameter and r is the distance of the curve from the center at an angle $\theta$ from the horizontal, each shell module having a port in one quadrant bounded by the circular arc about the center whose radius is equal to one and a half times the slotted shaft's diameter, the horizontal line passing through the center from which $\theta$ is reckoned, the vertical line located half the thickness of the blade from the center, and the sweeping cavity; said shell modules being divided into two contiguous uniformly arranged sets, the bottom set being attached to the suction end plate and having the same relative position of the ports forming an integral suction port, the top set being attached to the discharge end plate having the same relative position of the ports forming an integral discharge port, the radial sides of the two integral ports being colinear orthographically in the assembled pump;

D. suction and discharge end plates serving as sidings of the pumping chamber which are similar to the shell module in all respects except that the sweeping cavity is replaced by a continuous bore and countersunk recess in the center where the sleeve bearing is force fitted; and E. two sleeve bearings pressed into the center holes of the end plates, both having continuous round holes with countersunk tapered recesses that journal, support and prevent or minimize the radial and axial movement of the slotted shaft.

* * * * *